US009461358B2

(12) United States Patent
Feller

(10) Patent No.: US 9,461,358 B2
(45) Date of Patent: Oct. 4, 2016

(54) FRACTAL GROUND PLANE ANTENNA AND METHOD OF USE

(71) Applicant: HEMISPHERE GNSS INC., Scottsdale, AZ (US)

(72) Inventor: Walter J. Feller, Airdrie (CA)

(73) Assignee: Hemisphere GNSS Inc., Scottsdale, AZ (US)

( * ) Notice: Subject to any disclaimer, the term of this patent is extended or adjusted under 35 U.S.C. 154(b) by 259 days.

(21) Appl. No.: 14/338,789

(22) Filed: Jul. 23, 2014

(65) Prior Publication Data

US 2015/0048990 A1 Feb. 19, 2015

Related U.S. Application Data

(60) Provisional application No. 61/866,378, filed on Aug. 15, 2013.

(51) Int. Cl.

| | |
|---|---|
| ***H01Q 1/48*** | (2006.01) |
| ***H01Q 1/36*** | (2006.01) |
| ***H01Q 19/10*** | (2006.01) |
| ***H01Q 21/24*** | (2006.01) |

(52) U.S. Cl.

CPC ..... *H01Q 1/48* (2013.01); *H01Q 1/36* (2013.01); *H01Q 19/10* (2013.01); *H01Q 21/24* (2013.01); *Y10T 29/49016* (2015.01)

(58) Field of Classification Search

CPC ..... H01Q 1/36; H01Q 19/10; H01Q 1/48; H01Q 21/24; Y10T 29/49016

See application file for complete search history.

(56) References Cited

U.S. PATENT DOCUMENTS

| | | | | |
|---|---|---|---|---|
| 5,534,882 A * | 7/1996 | Lopez | H01Q 21/24 343/798 |
| 6,111,549 A * | 8/2000 | Feller | H01Q 9/28 343/700 MS |
| 6,140,975 A * | 10/2000 | Cohen | H01Q 1/243 343/792.5 |
| 7,215,290 B2 | 5/2007 | Cohen | |
| 8,102,325 B2 * | 1/2012 | Feller | H01Q 1/42 343/757 |

* cited by examiner

*Primary Examiner* — Trinh Dinh

(74) *Attorney, Agent, or Firm* — Schmeiser, Olsen & Watts LLP

(57) ABSTRACT

A Global Navigation Satellite System (GNSS) electronic circuit is described that uses an antenna and a fractal ground plane conductor or a fractal counterpoise. Some embodiments of the electronic circuit include a first ground plane conductor portion on a first electronic substrate, and a second ground plane conductor portion on a second electronic substrate. The second ground plane conductor portion is shaped to include at least one fractal pattern. The fractal pattern of the second ground plane conductor portion makes the ground plane seem electrically larger than it is. The fractal ground plane conductor portion minimizes the reception of GNSS satellite signals below the antenna, and improves the reception of signals from low elevation GNSS satellites above the horizon.

20 Claims, 15 Drawing Sheets

FRACTAL GROUND PLANE ANTENNA AND METHOD OF USE

CROSS REFERENCE TO RELATED APPLICATION

This application claims priority to U.S. Provisional patent application to Walter Feller entitled "GNSS Antenna Fractal Ground Plane" Ser. No. 61/866,378 filed Aug. 15, 2013, the disclosure of which is hereby incorporated entirely herein by reference.

BACKGROUND OF THE INVENTION

1. Technical Field

This invention relates generally to antenna circuits and in particular to an antenna circuit with a fractal ground plane.

2. State of the Art

Global Navigation Satellite Systems are in widespread use to determine the location and/or attitude of a body. A Global Navigation Satellite System (GNSS) includes a network of satellites that broadcast GNSS radio signals. GNSS receivers are able to determine their location by receiving GNSS satellite signals from a number of different GNSS satellites. Examples of GNSS systems include Navstar Global Positioning System (GPS), established by the United States; Globalnaya Navigatsionnay Sputnikovaya Sistema, or Global Orbiting Navigation Satellite System (GLONASS), established by the Russian Federation and similar in concept to GPS; and Galileo, also similar to GPS but created by the European Community and slated for full operational capacity in the near future.

It is necessary for a GNSS receiver to receive GNSS satellite signals from a number of different GNSS satellites in order to compute location or attitude. The GNSS receiver obtains the GNSS satellite signals from a GNSS antenna. The ideal gain pattern for a GNSS antenna has gain only above the horizon (about 5 degrees above and higher) and no gain below the horizon. Achieving this ideal gain pattern would require an infinitely large ground plane electrically coupled to the GNSS antenna. While a ground plane of infinite size is not feasible, increasing the size of the ground plane is desirable. However, increasing the physical size of an antenna's ground plane conflicts with the common requirement of small size for portable products. Thus what is needed is a ground plane for use with a GNSS antenna that appears electrically larger than its physical size.

DETAILED DESCRIPTION OF EMBODIMENTS OF THE INVENTION

Figure 1:
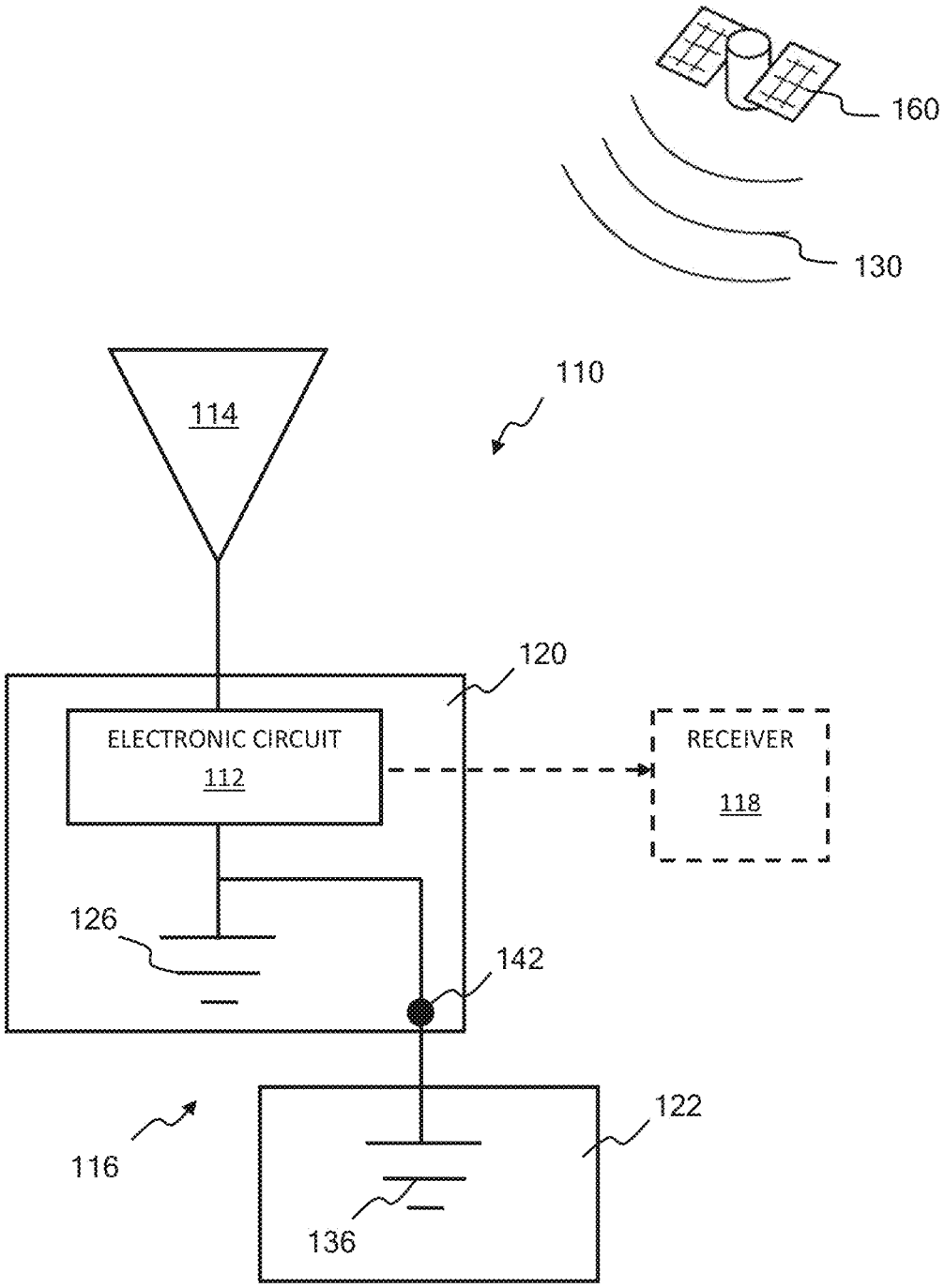
FIG. 1 is a block diagram of an electronic circuit with a first and a second ground plane conductor portion according to an embodiment of the invention.

Disclosed herein is a fractal ground plane antenna and method of use. A fractal ground plane antenna is an antenna with a fractal ground plane or counterpoise electrically coupled to the antenna. The fractal ground plane or counterpoise is often electrically connected to the antenna through some form of electronic circuitry. The embodiments disclosed herein include a fractal ground plane, but it is to be understood that the fractal ground plane can alternatively be implemented as a counterpoise to the antenna. A fractal ground plane is an electrically conductive material that is electrically connected to ground, and that is shaped to include at least one fractal pattern. A fractal pattern is a shape that includes the repetition of a base design or "generator", as is known in the art of fractal patterns. The base generator is a shape that is replicated repeatedly to create the fractal pattern. The generator can be rotated, translated, or scaled within the fractal pattern. A plurality of fractal generators are used to create a fractal pattern. Fractal patterns, where each fractal pattern includes a plurality of fractal generators, can be connectedly duplicated to create a larger fractal pattern.

The fractal pattern is used in embodiments of the invention as part of the ground plane or counterpoise in order to improve the gain pattern of an antenna. In disclosed embodiments the fractal ground plane antenna is part of a Global Navigation Satellite System (GNSS).

Global Navigation Satellite Systems are in widespread use to determine the location and/or attitude of a body. A Global Navigation Satellite System includes a network of satellites that broadcast GNSS radio signals. GNSS satellite signals allow a user to determine the location of a receiving antenna, and/or the attitude of a body that has a pair of receiving antennas fixed to it. Location is determined by receiving GNSS satellite signals from multiple GNSS satellites in known positions, determining the transition time for each of the GNSS satellite signals, and solving for the position of the receiving antenna based on the known data. The location of two or more receiving antennas that have known placements relative to an object can be used to determine the attitude of the object. An example of a well-known GNSS system is the Navstar Global Positioning System (GPS) in use in the United States.

The ideal gain pattern for a GNSS antenna has gain only above the horizon (5 degrees above and higher) and no gain below the horizon. This ideal gain pattern would minimize the reception of reflections (multipath) which result in at least two GNSS satellite signal paths, the direct and the reflection, to the antenna. Multipath is one of the largest error sources for satellite positioning systems due to the smearing of the time alignment measurement for the GNSS satellite ranges. There are digital methods to reduce multipath in the GNSS circuitry, but it is best is to not pick up multipath at all at the antenna.

In order to have gain only above the horizon as described above, the GNSS antenna and associated circuitry would need an infinitely large ground plane. Since this is not practical, all ground planes are truncated. And because many applications are portable, on a survey pole, a vehicle, or a hand-held device, for example, a smaller ground plane and GNSS antenna is preferred for packaging considerations. Disclosed embodiments use a ground plane that includes at least one fractal pattern in order to make the ground plane seem electrically larger than its physical size. The fractal pattern helps by increasing the number and distribution of small discontinuities which radiate a small amount of signal. As there are many of these and they are pseudo-randomly distributed with a non-wavelength dependent spacing, the radiated energy cancels at a distance. This has the effect that the currents induced on the fractal ground plane by the radiating pattern tend to be absorbed and canceled, which makes the ground plane appear electrically larger.

Figure 2:
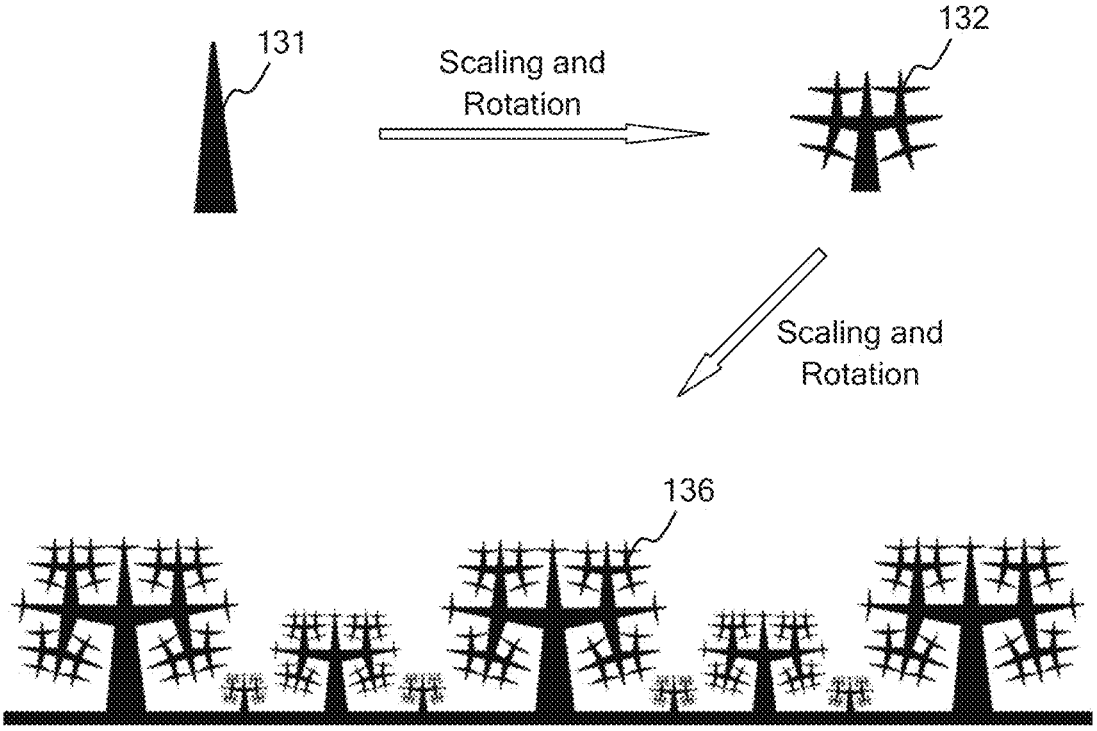
FIG. 2 is a front view of an embodiment of a ground plane conductor portion that includes fractal patterns.
Figure 3:
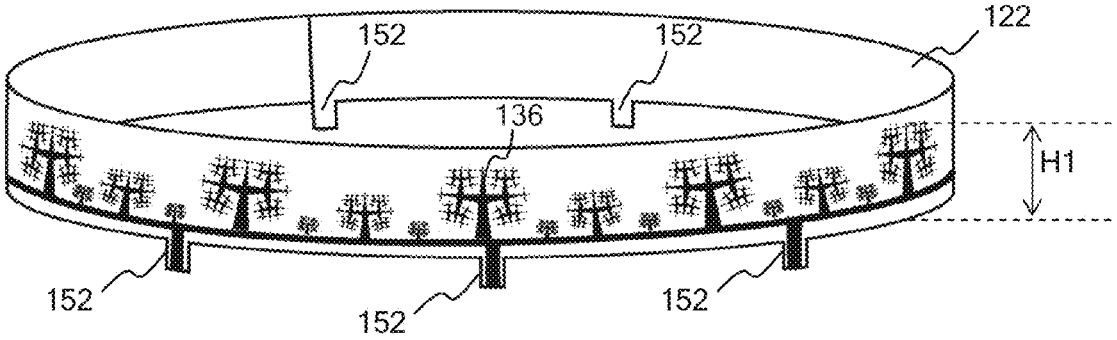
FIG. 3 is a perspective view of a fractal ground plane conductor portion on a flexible substrate, with the flexible substrate formed into an annular ring.
Figure 4:
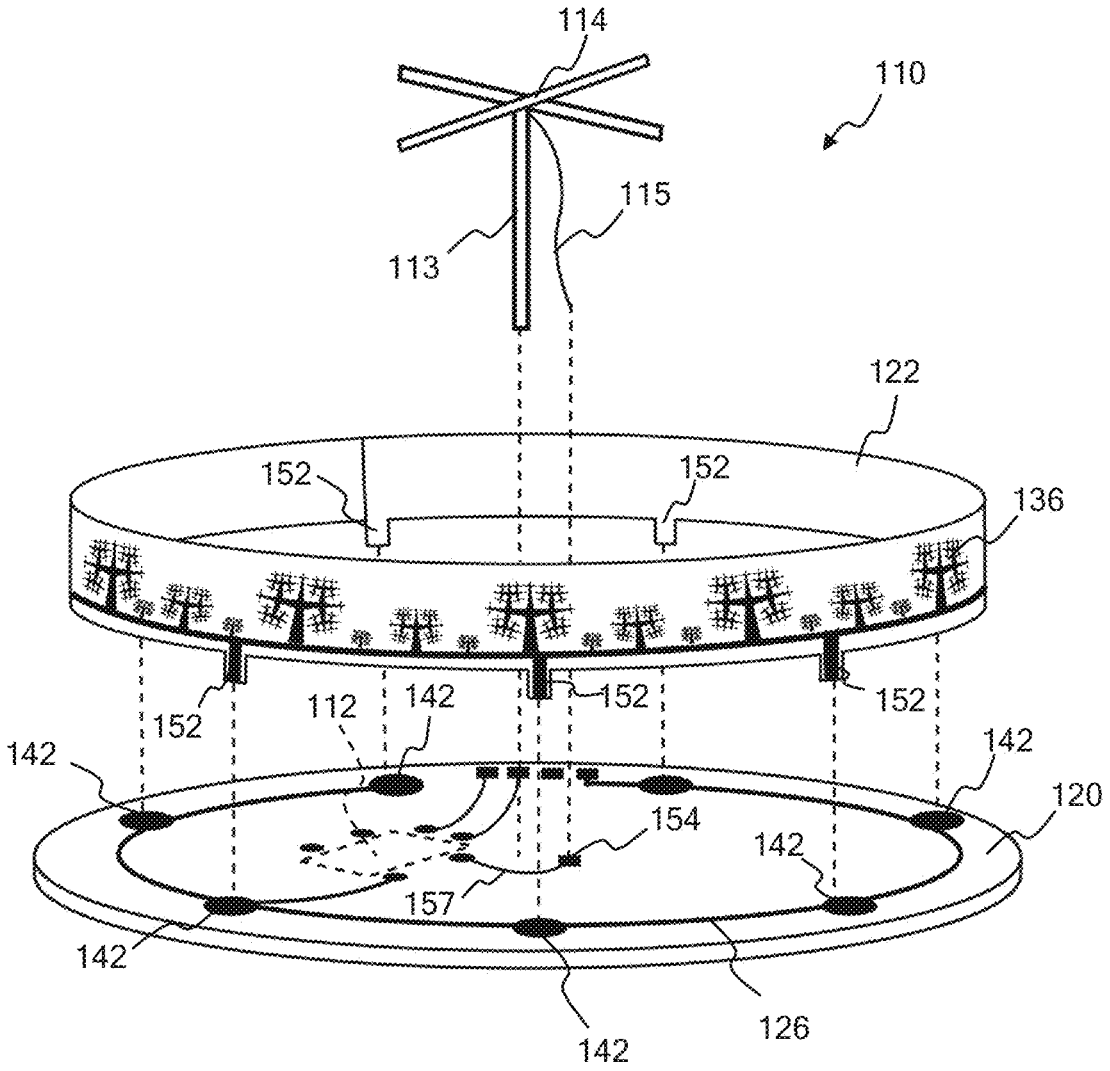
FIG. 4 is an exploded view of an embodiment of a GNSS electronic circuit with an antenna and a fractal ground plane conductor portion.
Figure 5:
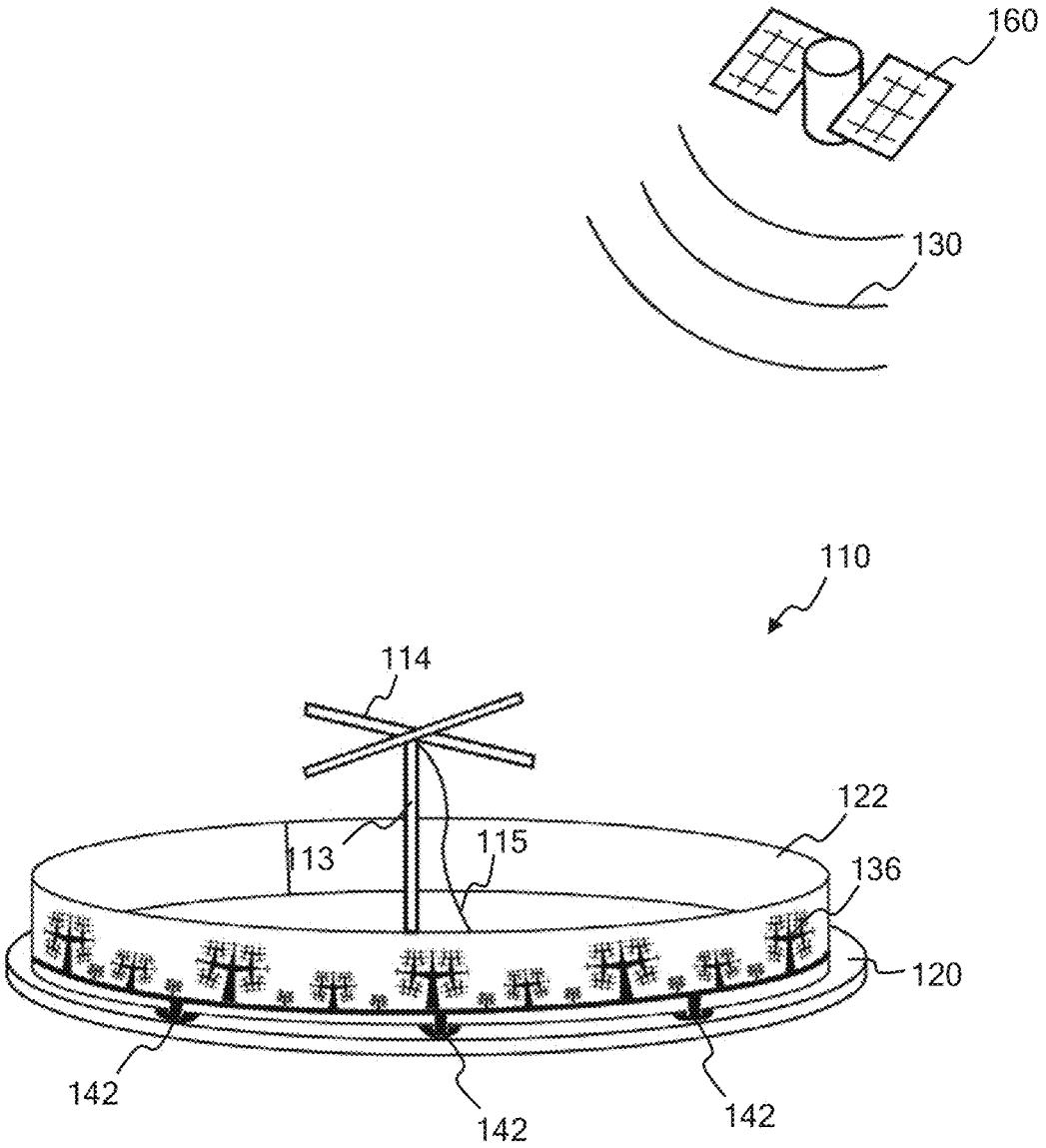
FIG. 5 is a perspective view of the GNSS electronic circuit with an antenna and the fractal ground plane conductor portion of FIG. 4.
Figure 6:
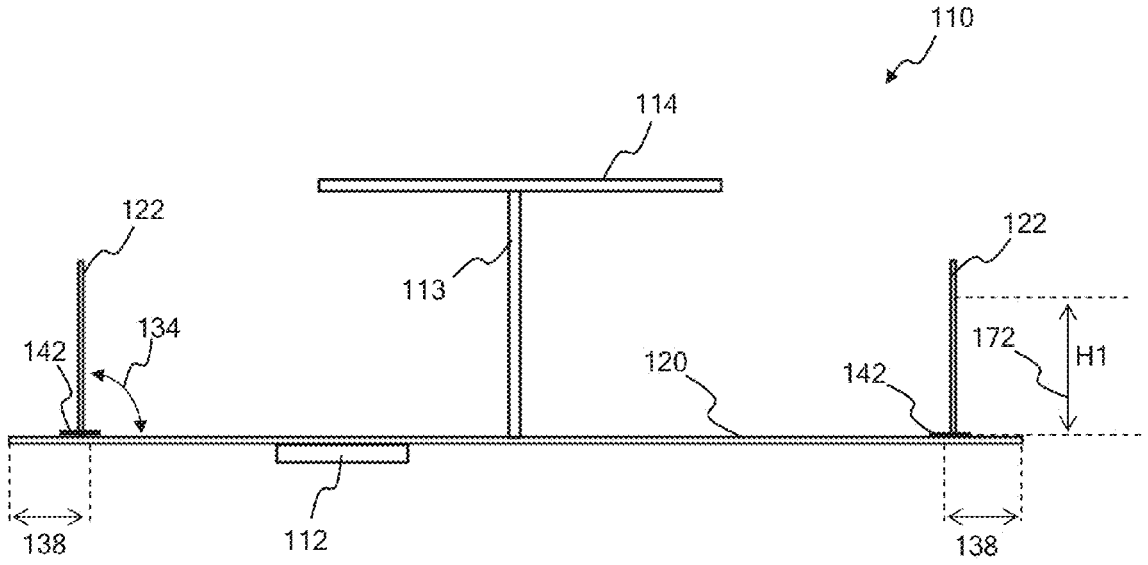
FIG. 6 is a side cross-section view of the GNSS electronic circuit with an antenna and the fractal ground plane conductor portion of FIG. 4.
Figure 7:
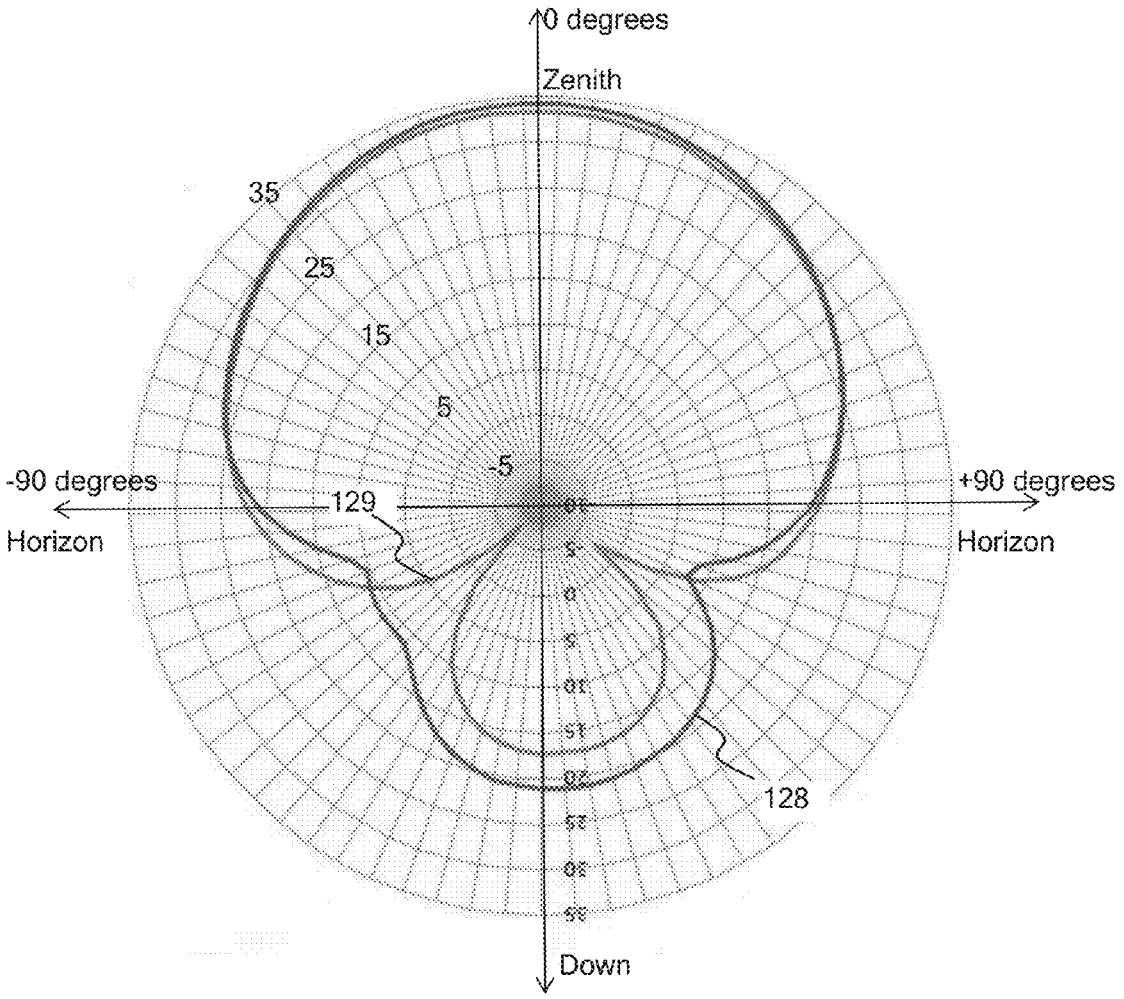
FIG. 7 shows example gain patterns of a GNSS antenna with and without a fractal ground plane conductor portion.

FIG. 1 through FIG. 7 show details of one embodiment of the invention in the the form of GNSS electronic circuit 110 including antenna 114 and fractal ground plane conductor portion 136. FIG. 1 shows a simplified schematic drawing of electronic circuit 110. FIG. 2 shows a front view of an embodiment of fractal ground plane conductor portion 136 used in electronic circuit 110, where fractal ground plane conductor portion 136 is shaped to include a plurality of fractal patterns. FIG. 3 shows a perspective view of fractal ground plane conductor portion 136 formed on a ring-shaped flexible electronic substrate 122 that is used with electronic circuit 110 of FIG. 1. FIG. 4 is an exploded perspective view of electronic circuit 110 of FIG. 1. FIG. 5 is a perspective view of electronic circuit 110 of FIG. 1. FIG. 6 is a side view cross section of electronic circuit 110 of FIG. 1, and FIG. 7 is a gain plot showing the gain pattern of antenna 114 of electronic circuit 110 with and without fractal ground plane conductor portion 136.

Electronic circuit 110 of FIG. 1 through FIG. 6 is a GNSS navigational device in this embodiment. Embodiments of the invention can be used in many other types of circuits and devices, and are not limited to use with GNSS circuits or devices. GNSS electronic circuit 110 includes antenna 114, electronic circuit 112, and ground plane 116. Antenna 114 is configured to receive GNSS satellite signals from GNSS satellites. In the embodiment shown in FIG. 1 through FIG. 6, antenna 114 is configured to receive GNSS satellite signal 130 from GNSS satellite 160. GNSS satellite signal 130 is received by antenna 114. GNSS satellite signal 130 travels from antenna 114 to receiver unit 118 through electronic circuit 112. Electronic circuit 112 in this embodiment is low noise amplifier circuit 112. Once GNSS satellite signal 130 reaches receiver 118, GNSS satellite signal 130 is down-converted and digitally sampled so that GNSS satellite 160 may be tracked by digital tracking loops of receiver 118. Various timing and navigation information is extracted from GNSS satellite signal 130 by receiver 118, including the phase of a Pseudo Random Noise (PRN) code timing pattern that is modulated on GNSS satellite signal 130, the carrier phase $\phi$ of GNSS satellite signal 130, and navigation data from which the location of GNSS satellite 160 may be computed. It will be appreciated that while one antenna 114, one GNSS satellite 160 and one GNSS satellite signal 130 is shown in the figures, in some embodiments GNSS electronic circuit 110 employs a plurality of antennas, and receives a plurality of GNSS satellite signals from a plurality of GNSS satellites. Receiver 118 receives the plurality of GNSS satellite signals and performs a variety of location and navigation computations using the plurality of GNSS satellite signals.

Electronic circuit 112, which in this embodiment is low noise amplifier 112, is electrically connected to antenna 114. Low noise amplifier circuit 112 receives GNSS satellite signal 130 from antenna 114, conditions GNSS satellite signal 130, and delivers GNSS satellite signal 130 to receiver 118. Low noise amplifier circuit 112 in this embodiment resides on a bottom side of first electronic substrate 120 to isolate electronic circuit 112 from antenna 114, but this is not meant to be limiting. In some embodiments electronic circuit 112 is on a top side of first electronic substrate 120. Electronic circuit 112 can be any type of electronic circuit that receives GNSS satellite signal 130 from antenna 114. In this embodiment electronic circuit 112 amplifies GNSS satellite signal 130 and delivers it to receiver 118, but this is not meant to be limiting. In some embodiments electronic circuit 112 is self-contained and does not output signals to other circuitry. This is indicated in FIG. 1 by receiver 118 being optional—in dotted lines. In some embodiments receiver 118 is part of electronic circuit 112. In some embodiments receiver 118 resides on first electronic substrate 120. In some embodiments electronic circuit 110 is not part of a GNSS, and electronic circuit 110 and electronic circuit 112 receive and process other types of signals with antenna 114.

GNSS electronic circuit 110 in this embodiment includes ground plane 116. Ground plane 116 is electrically connected to low noise amplifier circuit 112. Ground plane 116 is electrically connected to antenna 114 through low noise amplifier circuit 112. Ground plane 116 in this embodiment includes first ground plane conductor portion 126, and second ground plane conductor portion 136. Both first and second ground plane conductor portions 126 and 136 are made of an electrically conductive material that in this embodiment is used as a ground plane for electronic circuit 110. Second ground plane conductor portion 136 is electrically connected to first ground plane conductor portion 126 at ground connection point 142 in this embodiment. In the embodiment shown in FIG. 1 through FIG. 6, first ground plane conductor portion resides on first electronic substrate 120, and second ground plane conductor portion 136 resides on second electronic substrate 122. In some embodiments second ground plane conductor portion 136 resides on first electronic substrate 120.

First electronic substrate 120 is a disc-shaped printed circuit board in this embodiment, but this is not meant to be limiting. First electronic substrate can be any substrate type or shape for holding electronic circuitry. Second electronic substrate 122 in this embodiment is a flexible electronic substrate that is formed into an annular ring as shown in FIG. 3 through FIG. 6. In some embodiments second ground plane conductor portion 136 resides on first electronic substrate 120. In some embodiments, several of which will be discussed shortly, ground plane 116 includes a plurality of secondary ground plane conductor portions, where each of the plurality of secondary ground plane conductor portions resides on one of a plurality of secondary electronic substrates.

Second ground plane conductor portion 136 (also referred to as fractal ground plane conductor portion 136) is shaped to include at least one fractal pattern. In this embodiment second ground plane conductor portion 136 is shaped to include a plurality of fractal patterns as shown in FIG. 2. A fractal pattern is a pattern that includes the replication of a base generator, also known as a motif or design in the art of fractal patterns. The base generator is a pattern that is replicated to create the fractal pattern. The base generator can be rotated, translated, and/or scaled to create a fractal pattern. FIG. 2 shows base generator 131, which is the triangle-shaped base generator that is scaled and rotated to create fractal pattern 132. Fractal pattern 132 is then scaled and rotated to create the shape of second ground plane conductor portion 136 in this embodiment.

The fractal patterns discussed herein are second order fractal patterns, meaning the base generator is replicated in at least two sizes to create the fractal pattern, as is known in the art of fractal patterns. FIG. 2 shows an example of a ground plane conductor portion 136 that is shaped to include second order fractal patterns. Each of the "tree-shaped" patterns 132 in fractal ground plane conductor 136 is a fractal pattern. Each "tree-shaped" fractal pattern 132 is formed of a plurality of triangular fractal base generators 131, which are the shapes that are replicated in a multiplicity of sizes and orientations to form the fractal pattern. Changing the size means scaling the fractal generator and changing orientation means rotation of the fractal generator. In some embodiments the fractal pattern includes a plurality of fractal generators that are replicated in at least two sizes and at least two orientations. In the embodiment shown, each tree-shaped pattern 132 includes at least two replications of the triangle base generator 131 in at least two sizes and at least two orientations. As is common with fractal patterns, an individual fractal pattern can be used as a fractal generator to create a further fractal pattern. In other words some of the tree-shaped fractal patterns in fractal ground plane conductor portion 136 includes at least two replications of the tree-shaped pattern 132, with the tree-shaped pattern 132 replicated in at least two sizes and at least two orientations. In this embodiment the triangle fractal base generator 131 is used to create the tree-shaped fractal pattern 132. The tree-shaped fractal pattern 132 is then used as a fractal generator, where it is replicated to create the larger and more complex fractal patterns of second ground plane conductor 136. It is to be understood that there are many different fractal shapes that can be used for fractal ground plane conductor portion 136. The fractal shape causes second ground plane conductor portion 136 to appear electrically larger than it physically is when second ground plane conductor portion 136 is electrically connected to antenna 114. The fractal pattern helps by increasing the number and distribution of small discontinuities which radiate a small amount of signal. As there are many of these and they are pseudo-randomly distributed with a non-wavelength dependent spacing, the radiated energy cancels at a distance. This has the effect that the currents induced on ground plane 116 by the radiating pattern tend to be absorbed and cancel, resulting in second ground plane conduction portion 136 appearing electrically larger than its physical size.

FIG. 7 shows the improvement in gain performance of antenna 114 of electronic circuit 110 resulting from the use of second ground plane conductor portion 136 as shown in FIG. 1 through FIG. 6. FIG. 7 is a gain plot, showing the gain 128 of antenna 114 without the use of second ground plane conductor portion 136, and gain 129 of antenna 114 with the use of second ground plane conductor portion 136. The graph shows gain versus elevation angle, with the zero degree angle representing the zenith, or straight up into the sky from antenna 14. Plus and minus 90 degrees is at the horizon. The concentric radial rings represent increasing gain, with the center being minus 10 decibels of gain, and the gain increasing radially out to plus 35 decibels of gain at the outer ring. It can be seen that the use of fractal ground plane conductor portion 136 decreased the gain of antenna 14 below the horizon by about 2-10 decibels, and yet slightly increases the gain just above the horizon. This will improve the performance of antenna 114 and GNSS electronic circuit 110 by decreasing the reception of multipath GNSS satellite signals at or near the horizon.

Fractal ground plane conductor portion 136 has a maximum fractal pattern height H1 on second electronic substrate 122 shown in FIG. 3. Fractal pattern height H1 is the maximum height of fractal ground plane conductor 136 above first electronic substrate 120. The height of the individual fractal patterns varies along second electronic substrate 122 in this embodiment. Second ground plane conductor portion 136 is shaped to include a plurality of fractal patterns, and second ground plane conductor portion 136 also extends down tabs 152 of second electronic substrate 122. Tabs 152 are formed such that second ground plane conductor portion 136 will meet ground connection points 142 at tabs 152 when second electronic substrate 122 is placed on first electronic substrate 120 as shown in FIG. 4 through FIG. 6. Second ground plane conductor portion 136 is soldered or otherwise electrically connected to first ground plane conductor portion 126 at ground connection points 142. Second ground plane conductor portion 136 is electrically connected to first ground plane conductor portion 126 at ground connection points 142 in response to second ground plane conductor portion 136 on tabs 152 being electrically connected to ground connection points 142.

In the embodiment shown in FIG. 1 through FIG. 6, second electronic substrate 122 is formed into an annular ring, and coupled to first electronic substrate 120 at periphery 138 of first electronic substrate 120 (FIG. 6). Periphery 138 is the outer edge of first electronic substrate 120. Periphery in this context means the area of first electronic substrate 120 outside of the active circuitry such as antenna 114 and electronic circuit 112. In some embodiments periphery 138 is the area of first electronic substrate 120 a predetermined radial distance from the center of first electronic substrate, where the predetermined radial distance is a radius greater than 95 percent of the radius of first electronic substrate 120. In some embodiments the predetermined radial distance is a radius greater than 90 percent of the radius of first electronic substrate 120. In some embodiments the predetermined radial distance is a radius greater than 80 percent of the radius of first electronic substrate 120.

Second electronic substrate 122 is coupled to first electronic substrate 120 at periphery 138 of first electronic substrate 120 in this embodiment, so that second electronic substrate 122, and in particular second ground plane conductor portion 136, encircles antenna 114, and first ground plane conductor portion 126. Second ground plane conductor portion 136 encircling antenna 114 and its associated electronics creates a ring of stray signal-canceling patterns, which contributes to the gain performance improvements seen in FIG. 7. In this embodiment second ground conductor portion 136 is coupled to first ground conductor portion 126 at plurality of ground connection points 142, where plurality of ground connection points 142 are within periphery 138 of first electronic substrate 120. It is to be understood that in some embodiments second electronic substrate 122 is coupled to first electronic substrate 120 in positions and locations outside periphery 138 of first electronic substrate 120.

In the embodiment shown in FIG. 1 through FIG. 6, first electronic substrate 120 is a circular disc with antenna 114 mounted approximately in the center of first electronic substrate 120. Antenna 114 is mechanically connected to first electronic substrate 120 with a mechanical mount 113, which can take many different forms as is known in the art. Antenna 114 is electrically connected to low noise amplifier electronic circuit 112 via electrical conductor 115, which electrically connects to low-noise amplifier circuit 112 via pad 154 and trace 157 on first electronic substrate 120 (FIG. 4).

It is to be understood that while electronic circuit 112 in this embodiment is low-noise amplifier circuit 112, this is not meant to be limiting to the invention. Electronic circuit 112 can be any electronic circuit, components, or elements which conditions, receives, and/or conducts signals from antenna 114. And while electronic circuit 112 in this embodiment is shown as a surface mount integrated circuit, electronic circuit 112 can be any form of electronic circuit that is connected to, mounted on, or integrated with electronic substrate 120. Electronic circuit 112 can take the form of discrete electronic elements, semiconductor chips, embedded elements, or any combination of these. Electronic circuit 112 can be formed or mounted on first electronic substrate 120 in any position.

Antenna 114 is encircled, or surrounded, by second ground plane conductor portion 136, as shown in FIG. 4 and FIG. 5. Second ground plane conductor portion 136 forms an annular ring around antenna 114 and first ground plane conductor portion 126 in this embodiment. Second ground plane conductor portion 136 is formed on second electronic substrate 122, which is mechanically coupled to periphery 138 of first electronic substrate 120 such that second electronic substrate 122 forms angle 134 (FIG. 6) between first and second electronic substrate 120 and 122. In this embodiment second electronic substrate 122 is approximately perpendicular to first electronic substrate 120, but this is not meant to be limiting to the invention. In this embodiment angle 134 is approximately 90 degrees. In some embodiments angle 134 is between about 80 and about 100 degrees. In some embodiments angle 134 is between about 70 and about 110 degrees. In some embodiments angle 134 is between about 25 and about 155 degrees. These values of angle 134 provide tailoring of the gain pattern of antenna 114, allowing the gain pattern to be optimized for differing product requirements.

The annular ring orientation of second electronic substrate 122 and second ground plane conductor portion 136 shown in the embodiment of electronic circuit 110 of FIG. 1 through FIG. 6 results in the fractal shaped patterns of second ground plane conductor portion 136 creating a vertical ring of fractal "posts" or "fingers" surrounding antenna 114. The size and shape of second electronic substrate 122 and second ground plane conductor portion 136 can be adjusted to different sizes, shapes, and orientations to adjust the placement, size, spacing, height, and angular orientation of the fractal patterns of second ground plane conductor portion 136 with respect to antenna 114. Second electronic substrate 122 and second ground plane conductor portion 136 can take many different forms and orientations to achieve different gain patterns for antenna 114. In some embodiments second ground plane conductor portion 136 is formed on first electronic substrate 120. In some embodiments second electronic substrate 122 forms rectilinear or curvilinear shapes, or a combination of both, which partially or fully surround antenna 114, some of which will be described below. In some embodiments second electronic substrate 122 forms a "meandering" shape with no defined function to it. In some embodiments second ground plane conductor portion 136 forms rectilinear or curvilinear shapes which partially or fully surround antenna 114, some of which will be described below.

Figure 8:
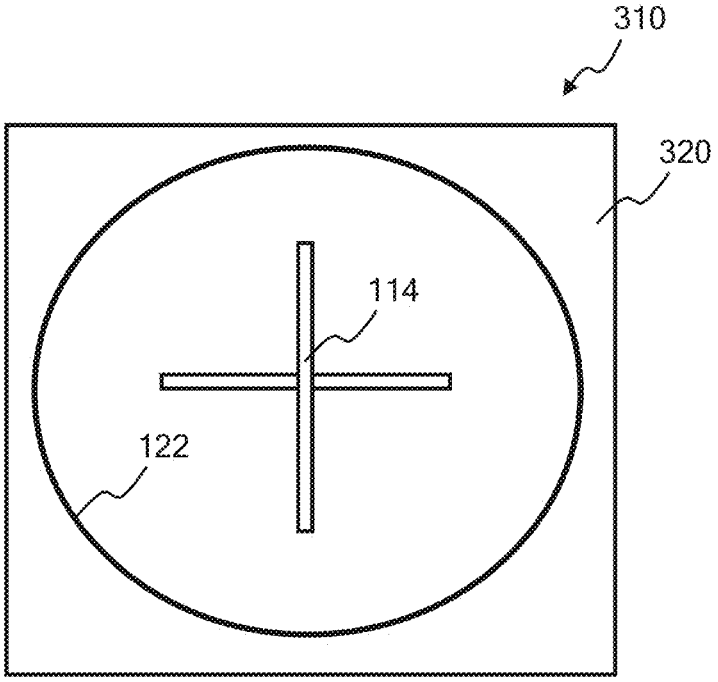
FIG. 8 is a top view of a further embodiment of a GNSS electronic circuit with an antenna and a first and a second electronic substrate.

First electronic substrate 120 is a flat circular disc in the embodiment of GNSS electronic circuit 110 shown in FIG. 1 through FIG. 6, but this is not meant to be limiting. First electronic substrate can be any shape or size desired. FIG. 8 is a top view of an embodiment of the invention in the form of GNSS electronic circuit 310, showing antenna 114, first electronic substrate 320, and second electronic substrate 122. GNSS electronic circuit 310 is similar to GNSS electronic circuit 110 of FIG. 1 through FIG. 6 and includes the same elements of GNSS electronic circuit 110, the only difference being that first electronic substrate 120 is replaced with first electronic substrate 320. In this embodiment first electronic substrate 320 has a rectangular shape. In this embodiment second ground plane conductor portion 136 resides on second electronic substrate 122, where second electronic substrate 122 encircles antenna 114. First electronic substrate 320 can be any shape and size according to the requirements of the particular application of electronic circuit 310 and antenna 114.

Second electronic substrate 122 is an annular ring in the embodiments shown in FIG. 1 through FIG. 6 and FIG. 8, but this is not meant to be limiting. Second electronic substrate 122 can be any size or a shape. In some embodiments second electronic substrate 122 forms a rectilinear shape instead of an annular ring. In some embodiments second electronic substrate 122 forms a rectilinear shape surrounding either antenna 114, low noise amplifier circuit 112, and/or first ground plane conductor portion 126. In some embodiments second ground plane conductor portion 136 forms a rectilinear shape instead of an annular ring. In some embodiments second ground plane conductor portion 136 forms a rectilinear shape surrounding either antenna 114, low noise amplifier circuit 112, and/or first ground plane conductor portion 126. In some embodiments of the invention, second ground plane conductor portion 136 is formed on a plurality of secondary electronic substrates, each of which is coupled to first electronic substrate 120 at a ground connection point 142. FIG. 9 through FIG. 13 show example embodiments of the invention where the fractal ground plane conductor portion is divided into a plurality of fractal ground plane conductor portions, where each of the plurality of fractal ground plane conductor portions resides on a secondary electronic substrate and each of the plurality of fractal ground plane conductor portions is electrically connected to first ground plane conductor portion 126.

Figure 9:
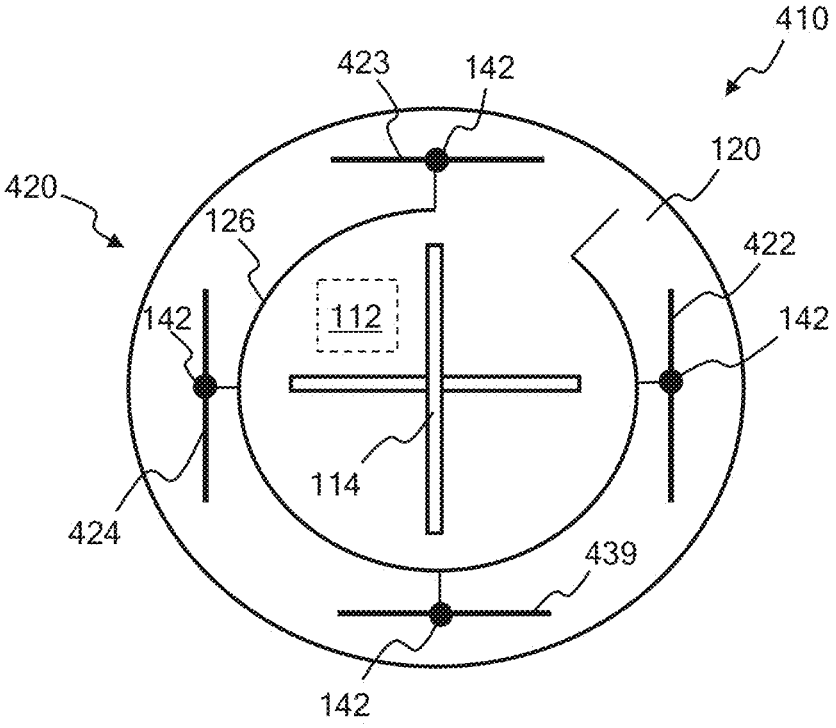
FIG. 9 is a top view of another embodiment of a GNSS electronic circuit with an antenna and a plurality of secondary electronic substrates.
Figure 10:
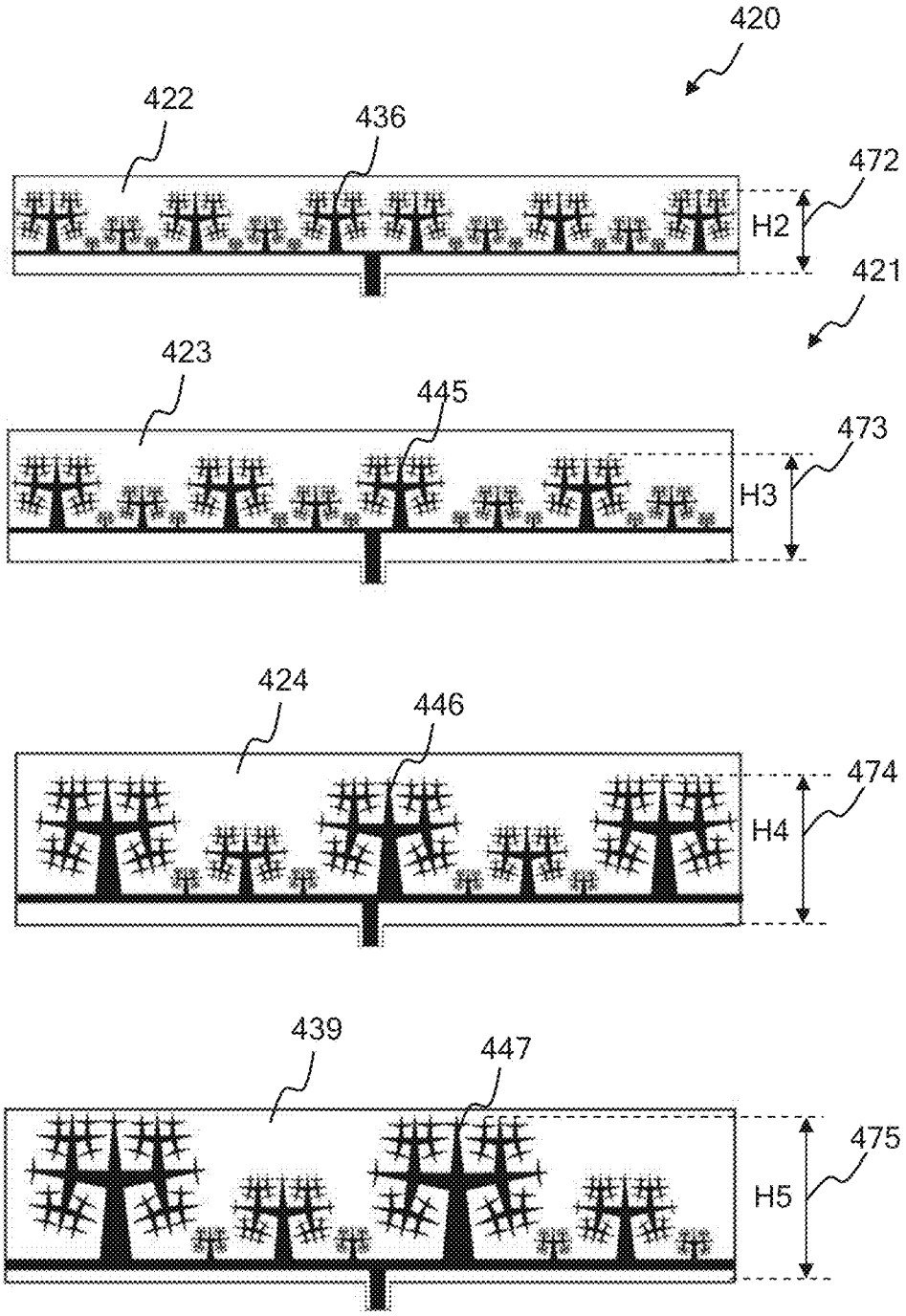
FIG. 10 is a front view of an embodiment of a plurality of secondary electronic substrates with one of a plurality of fractal ground plane conductors on each secondary electronic substrate.

FIG. 9 and FIG. 10 show an embodiment of the invention where the fractal ground plane conductor portion resides on several secondary electronic substrates. FIG. 9 is a top view of electronic circuit 410. Electronic circuit 410 is similar to electronic circuit 110 of FIG. 1 through FIG. 6 and includes the same elements, some of which are not shown in FIG. 9 for simplicity. Electronic circuit 410 includes antenna 114, first electronic substrate 120 and plurality of secondary electronic substrates 420. In this embodiment second electronic substrate 122 is replaced with plurality of secondary electronic substrates 420, which includes second electronic substrate 422, third electronic substrate 423, fourth electronic substrate 424, and fifth electronic substrate 439, as shown in FIG. 9 and FIG. 10. FIG. 10 is a front view of plurality of secondary electronic substrates 420. Second electronic substrate 422, third electronic substrate 423, fourth electronic substrate 424, and fifth electronic substrate 439 are each coupled to first electronic substrate 120 as shown in FIG. 9. Second electronic substrate 422, third electronic substrate 423, fourth electronic substrate 424, and fifth electronic substrate 439 form a rectilinear shape surrounding antenna 114 and low noise amplifier 112 in this embodiment. In some embodiments second electronic substrate 422, third electronic substrate 423, fourth electronic substrate 424, and fifth electronic substrate 439 are each coupled to periphery 138 of first electronic substrate 120.

Second ground plane conductor portion 136 is replaced by plurality of secondary ground plane conductor portions 421 in the embodiment shown in FIG. 9 and FIG. 10. Plurality of secondary ground plane conductor portions includes second ground plane conductor portion 436 on second electronic substrate 422, third ground plane conductor portion 445 on third electronic substrate 423, fourth ground plane conductor portion 446 on fourth ground plane conductor portion 424, and fifth ground plane conductor portion 447 on fifth electronic substrate 439. Each of second ground plane conductor portion 436, third ground plane conductor portion 445, fourth ground plane conductor portion 446 and fifth ground plane conductor portion 447 are shaped to include at least one fractal pattern, as shown in FIG. 10. Each of second ground plane conductor portion 436, third ground plane conductor portion 445, fourth ground plane conductor portion 446 and fifth ground plane conductor portion 447 are electrically connected to first ground plane conductor portion 126 at one of a plurality of ground connection points 142. In some embodiments each ground connection point 142 is on periphery 138 of first electronic substrate 120.

In this embodiment each of second ground plane conductor portion 436, third ground plane conductor portion 445, fourth ground plane conductor portion 446 and fifth ground plane conductor portion 447 have a maximum fractal pattern height, as shown in FIG. 10. Second ground plane conductor portion 436 has a maximum fractal pattern height H2 472 above first electronic substrate 120. Third ground plane conductor portion 445 has a maximum fractal pattern height H3 473 above first electronic substrate 120. Fourth ground plane conductor portion 446 has a maximum fractal pattern height H4 474 above first electronic substrate 120. And fifth ground plane conductor portion 447 has a maximum fractal pattern height H5 472 above first electronic substrate 120. In some embodiments the maximum fractal pattern heights H2 472, H3 473, H4 474, and H5 475 have the same height value. In some embodiments the height values of maximum fractal pattern heights H2 472. H3 473, H4 474, and H5 475 vary with respect to each other, as shown in FIG. 10. In this embodiment height H2 472 is less than height H3 473, which is less than height H4 474, which is less than H5 475. Varying the maximum fractal pattern heights H2 472, H3 473, H4 474, and H5 475 according to a predetermined pattern or function allows the gain pattern of antenna 114 to be tuned for specific applications. It is to be understood that the placement, location, height and orientation of second electronic substrate 422, third electronic substrate 423, fourth electronic substrate 424, and fifth electronic substrate 439 can vary with respect to first electronic substrate 120 and antenna 114 in order to adjust the gain pattern of antenna 114.

Figure 11:
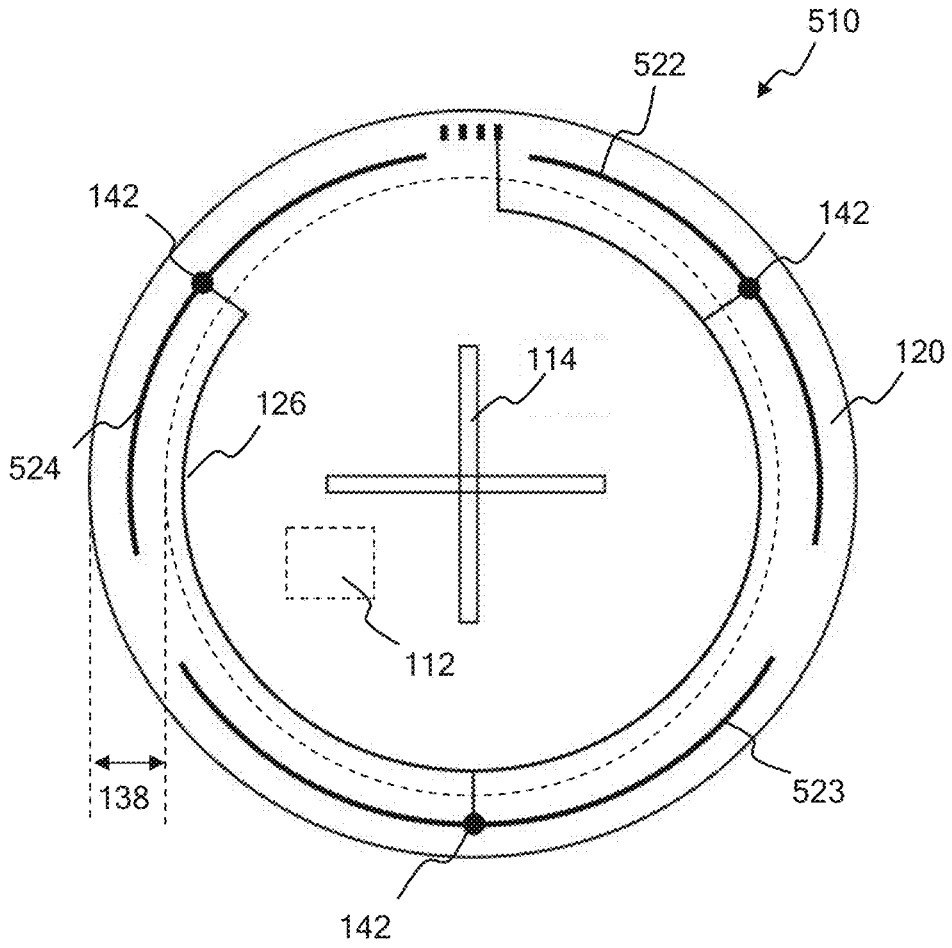
FIG. 11 is a top view of another embodiment of a GNSS electronic circuit with an antenna and a plurality of secondary electronic substrates.

FIG. 11 shows a top view of a further embodiment of the invention. FIG. 11 shows electronic circuit 510, which is similar to electronic circuit 110 of FIG. 1 through FIG. 6 and contains the same elements except that second ground plane conductor portion 136 is divided into a plurality of secondary ground plane conductor portions as in electronic circuit 410 of FIG. 9 and FIG. 10. In this embodiment secondary ground plane conductor portions reside on second electronic substrate 522, third electronic substrate 523, and fourth electronic substrate 524. Each of second electronic substrate 522, third electronic substrate 523, and fourth electronic substrate 524 are flexible electronic substrates in this embodiment, and each are formed into a segment of an annular ring.

In the embodiment of electronic circuit 510 shown in FIG. 11, second electronic substrate 522, third electronic substrate 523, and fourth electronic substrate 524 surround antenna 114, which causes the secondary ground plane conductor portions on second electronic substrate 522, third electronic substrate 523, and fourth electronic substrate 524 to surround antenna 114. It is to be understood, however, that the placement, location, and orientation of second electronic substrate 522, third electronic substrate 523 and fourth electronic substrate 524, can vary with respect to first electronic substrate 120 and antenna 114 in order to adjust the gain pattern of antenna 114. In some embodiments second electronic substrate 522, third electronic substrate 523 and fourth electronic substrate 524 are coupled to first electronic substrate 120 on periphery 138 of first electronic substrate 120.

Figure 12:
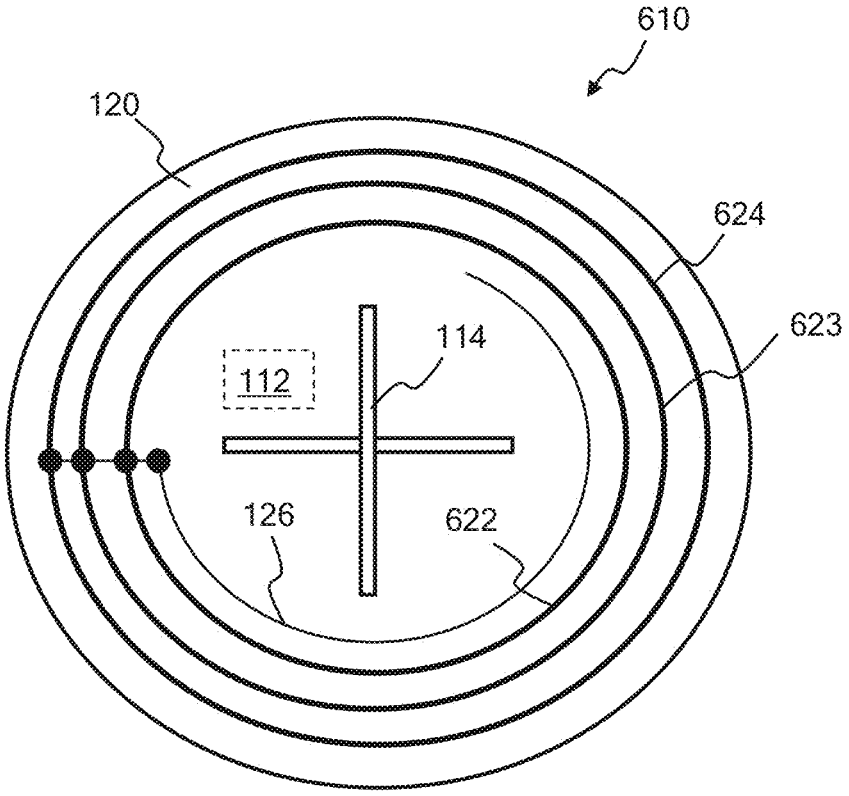
FIG. 12 is a top view of another embodiment of a GNSS electronic circuit with an antenna and a plurality of secondary electronic substrates.
Figure 13:
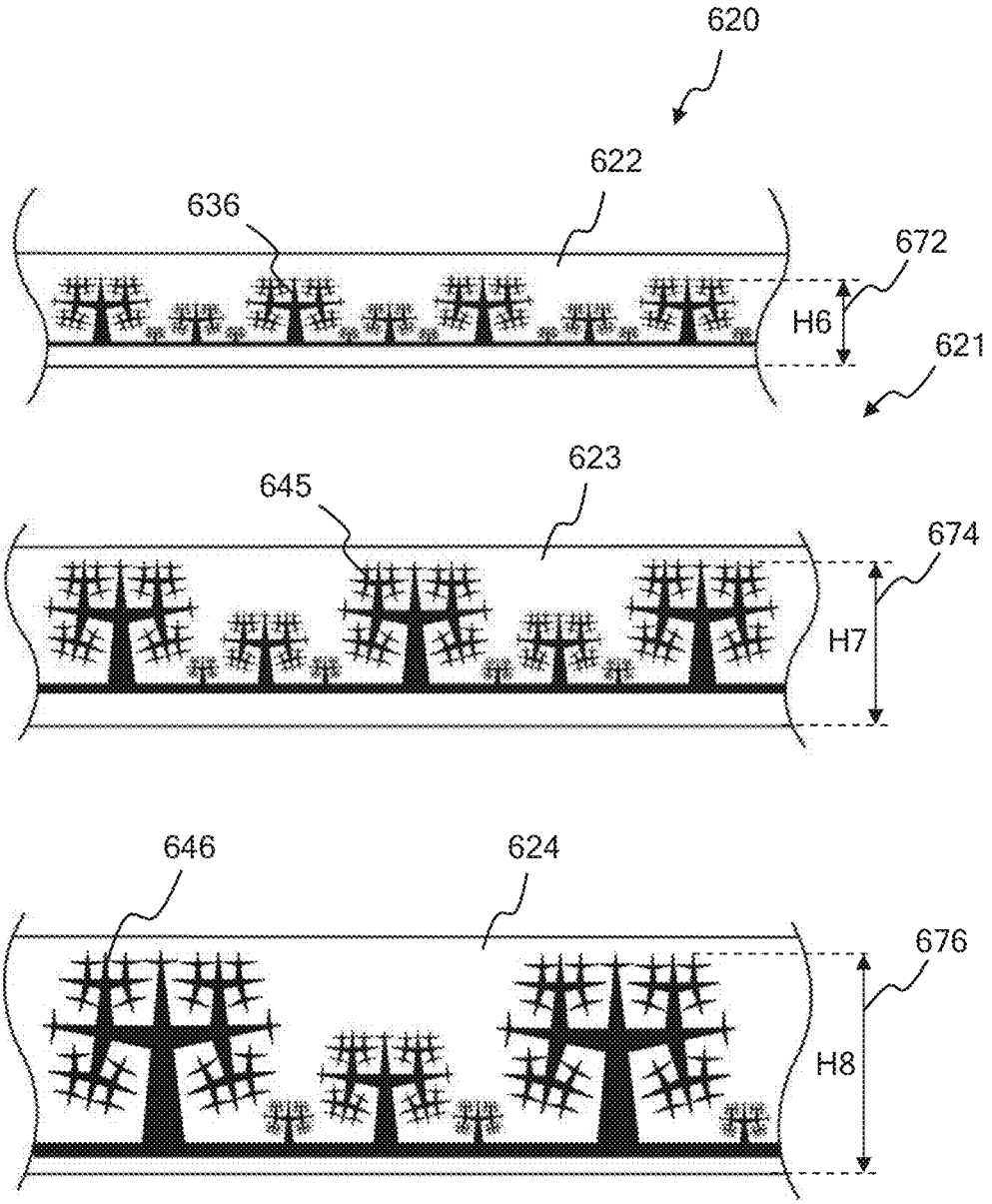
FIG. 13 is a side view of several embodiments of fractal ground plane conductor portions on secondary electronic substrates.
Figure 14:
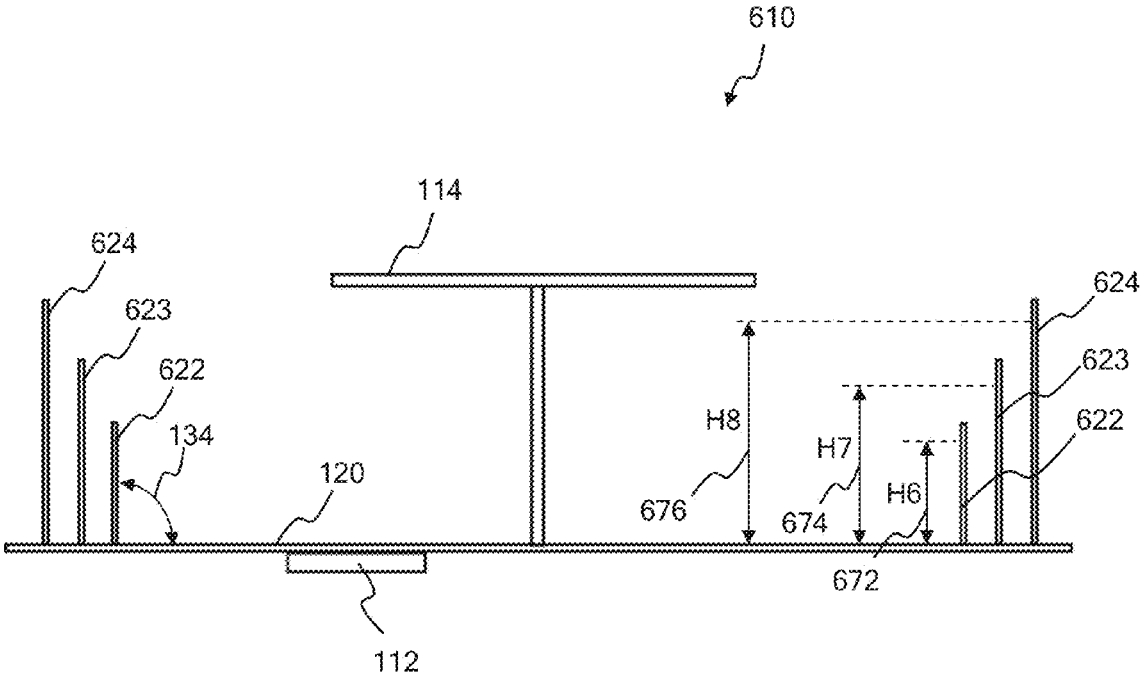
FIG. 14 is a side view of the GNSS electronic circuit with an antenna and the plurality of secondary electronic substrates of FIG. 12.

FIG. 12 through FIG. 14 illustrate a further embodiment of the invention. FIG. 12 shows a top view of electronic circuit 610. FIG. 13 shows front views of segments of plurality of secondary electronic substrates 620. FIG. 14 shows a side view cross-section of electronic circuit 610 of FIG. 12. GNSS electronic circuit 610 is similar to GNSS electronic circuit 110 of FIG. 1 through FIG. 6 and includes the same components and connections, except that second ground plane conductor portion 136 is replaced with plurality of secondary ground plane conductor portions 621 that includes second ground plane conductor portion 636, third ground plane conductor portion 645, and fourth ground plane conductor portion 646 as shown in FIG. 13. Each of second ground plane conductor portion 636, third ground plane conductor portion 645, and fourth ground plane conductor portion 646 is shaped to include at least one fractal pattern, as shown in FIG. 13. Electronic circuit 112 is formed on a bottom side of first electronic substrate 120 as in electronic circuit 110 of FIG. 1 through FIG. 6, and includes first ground plane conductor portion 126 as explained earlier with regard to FIG. 1 through FIG. 6. Antenna 114 is coupled to electronic circuit 112 as with electronic circuit 110. Antenna 114 is configured to receive GNSS satellite signals in this embodiment.

Second ground plane conductor portion 636, third ground plane conductor portion 645 and fourth ground plane conductor portion 646 reside on plurality of secondary electronic substrates 620. Second ground plane conductor portion 636 is formed on and resides on second electronic substrate 622 as shown in FIG. 13, and has a maximum fractal pattern height of H6 672 above first electronic substrate 120. Second ground plane conductor portion 636 is electrically connected to first ground plane conductor portion 126, as explained earlier with regard to electronic circuit 110. Second electronic substrate 622 is a flexible electronic substrate formed into an annular ring which encircles antenna 114 as shown in FIG. 12 and FIG. 14.

Third ground plane conductor portion 645 resides on third electronic substrate 623 as shown in FIG. 13, and has a maximum fractal pattern height of H7 674 above first electronic substrate 120. Third ground plane conductor portion 645 is electrically connected to first ground plane conductor portion 126, as explained earlier with regard to electronic circuit 110. Third electronic substrate 623 is a flexible electronic substrate formed into an annular ring which encircles antenna 114 as shown in FIG. 12 and FIG. 14. Fourth ground plane conductor portion 646 resides on fourth electronic substrate 624 as shown in FIG. 13, and has a maximum fractal pattern height of H8 676 above first electronic substrate 120. Fourth ground plane conductor portion 646 is electrically connected to first ground plane conductor portion 126, as explained earlier with regard to electronic circuit 110. Fourth electronic substrate 624 is a flexible electronic substrate formed into an annular ring which encircles antenna 114, as shown in FIG. 12 and FIG. 14.

In the embodiment shown in FIG. 12 through FIG. 14, second electronic substrate 622, third electronic substrate 623 and fourth electronic substrate 624 form concentric annular rings around antenna 114 as shown in the figures. Thus second ground plane conductor portion 636, third ground plane conductor portion 645, and fourth ground plane conductor portion 646 form concentric annular rings around antenna 114. In this embodiment second ground plane conductor portion 636, third ground plane conductor portion 645, and fourth ground plane conductor portion 646 form concentric annular rings of fractal shaped patterns around antenna 114. The fractal shaped patterns create fractal posts or fingers which surround antenna 114. In this embodiment second ground plane conductor portion 636, third ground plane conductor portion 645, and fourth ground plane conductor portion 646 form concentric annular rings of differing heights, but this is not meant to be limiting. In this embodiment the maximum fractal pattern height increases with increasing distance from antenna 114. In this embodiment the maximum fractal pattern height increases with increasing radial distance from the center of first electronic substrate 120. In this embodiment fractal pattern height H8 676, which is the maximum height of fourth ground plane conductor portion 646 above first electronic substrate 120, is greater than fractal pattern height H7 674, which is the maximum height of third ground plane conductor portion 645 above first electronic substrate 120. And fractal pattern height H7 674, which is the maximum height of third ground plane conductor portion 645 above first electronic substrate 120, is greater than fractal pattern height H6 672, which is the maximum height of second ground plane conductor portion 636 above first electronic substrate 120. In some embodiments the fractal pattern heights vary according to a predetermined function to create a specific desired gain pattern for antenna 114. In this embodiment second ground plane conductor portion 636 extends a first height H6 672 above first electronic substrate 120 and third ground plane conductor portion 645 extends second height H7 674 above first electronic substrate 120, where second height H7 674 is greater than first height H6 672. And in this embodiment fourth ground plane conductor portion 646 extends third height H8 676 above first electronic substrate 120, where third height H8 676 is greater than second height H7 674.

In the embodiment of electronic circuit 610 of FIG. 12 through FIG. 13, angle 134 (FIG. 14) between first electronic substrate 120 and second electronic substrate 622 is about 90 degrees, but this is not meant to be limiting. In some embodiments angle 134 between first electronic substrate 120 and second electronic substrate 622 is between 80 degrees and 100 degrees. In some embodiments angle 134 between first electronic substrate 120 and second electronic substrate 622 is between 70 degrees and 110 degrees. It is to be understood that second electronic substrate 622, third electronic substrate 623, and fourth electronic substrate 624 can have many different forms, configurations and orientations with respect to first electronic substrate 120. Adjusting the angle between first electronic substrate 120 and second electronic substrate 622 adjusts the angle that second ground plane conductor portion 636 has with respect to antenna 114, which can be used to tune the gain pattern of antenna 114. Similarly, the angles that third electronic substrate 623 and fourth electronic substrate 624 make with respect to first electronic substrate 120 can be changed to adjust the angles that third and fourth ground plane conductor portions 645 and 646 have with respect to antenna 114, providing further capability to adjust the gain of antenna 114.

Figure 15:
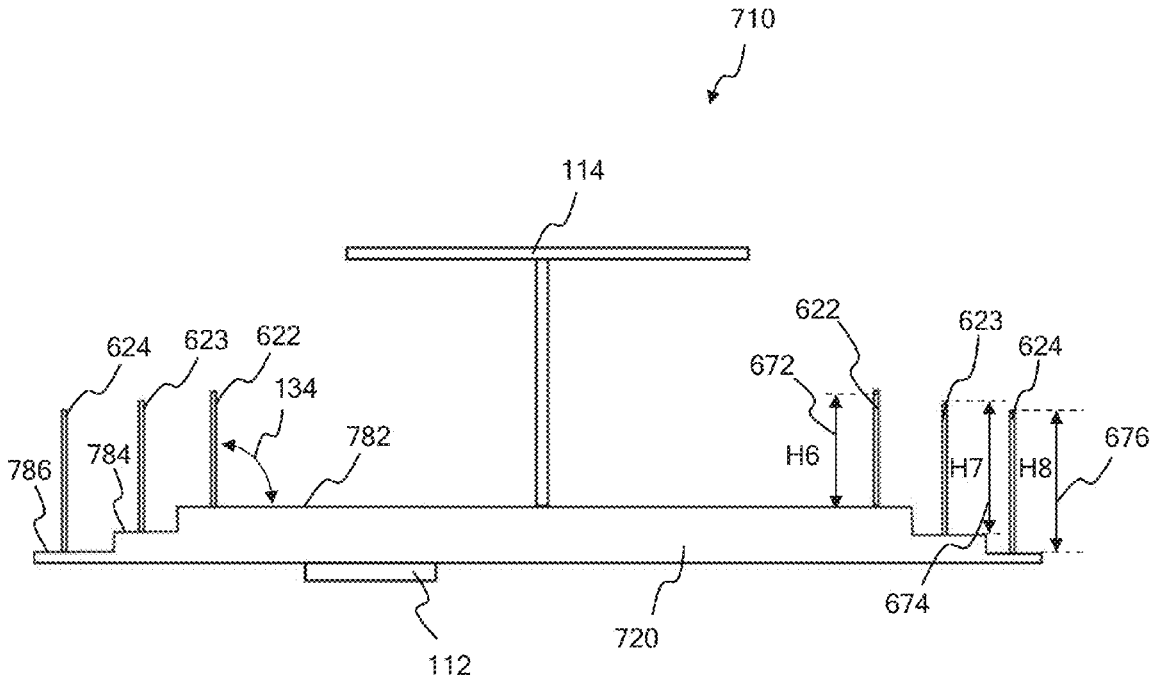
FIG. 15 is a side view of a further embodiment of a GNSS electronic circuit with an antenna and a plurality of secondary electronic substrates.

FIG. 15 illustrates a further embodiment of the invention. FIG. 15 shows a side view cross section of electronic circuit 710. GNSS electronic circuit 710 is similar to GNSS electronic circuit 610 of FIG. 12 through FIG. 14 and includes the same components and connections, except that GNSS electronic circuit 710 includes first electronic substrate 720 instead of first electronic substrate 120. First electronic substrate has stepped levels 782, 784, and 786. Stepped levels 782, 784, and 786 are different steps or levels of first electronic substrate 720. In this embodiment first ground plane conductor portion 126 resides on all of steps 782, 784, and 786, such that first ground plane conductor portion 126 includes steps. In this embodiment second electronic substrate 622 is coupled to first step 782 of first electronic substrate 720. Third electronic substrate 623 is coupled to second step 784 of first electronic substrate 720, and fourth electronic substrate 624 is coupled to third step 786. Thus in this embodiment first electronic substrate 720 includes steps 782, 784, and 786, first ground plane conductor portion 126 resides on all three steps 782, 784, and 786, and second, third, and fourth electronic substrate 622, 623, and 624 are coupled to first, second and third step 782, 784, and 786 respectively. This allows both the top end and the bottom end of the fractal patterns in second, third, and fourth ground plane conductor portions 636, 645, and 646 to be at different levels with respect to each other and with respect to first ground plane conductor portion 126, providing further capability for tuning of the gain pattern for antenna 114.

Figure 16:
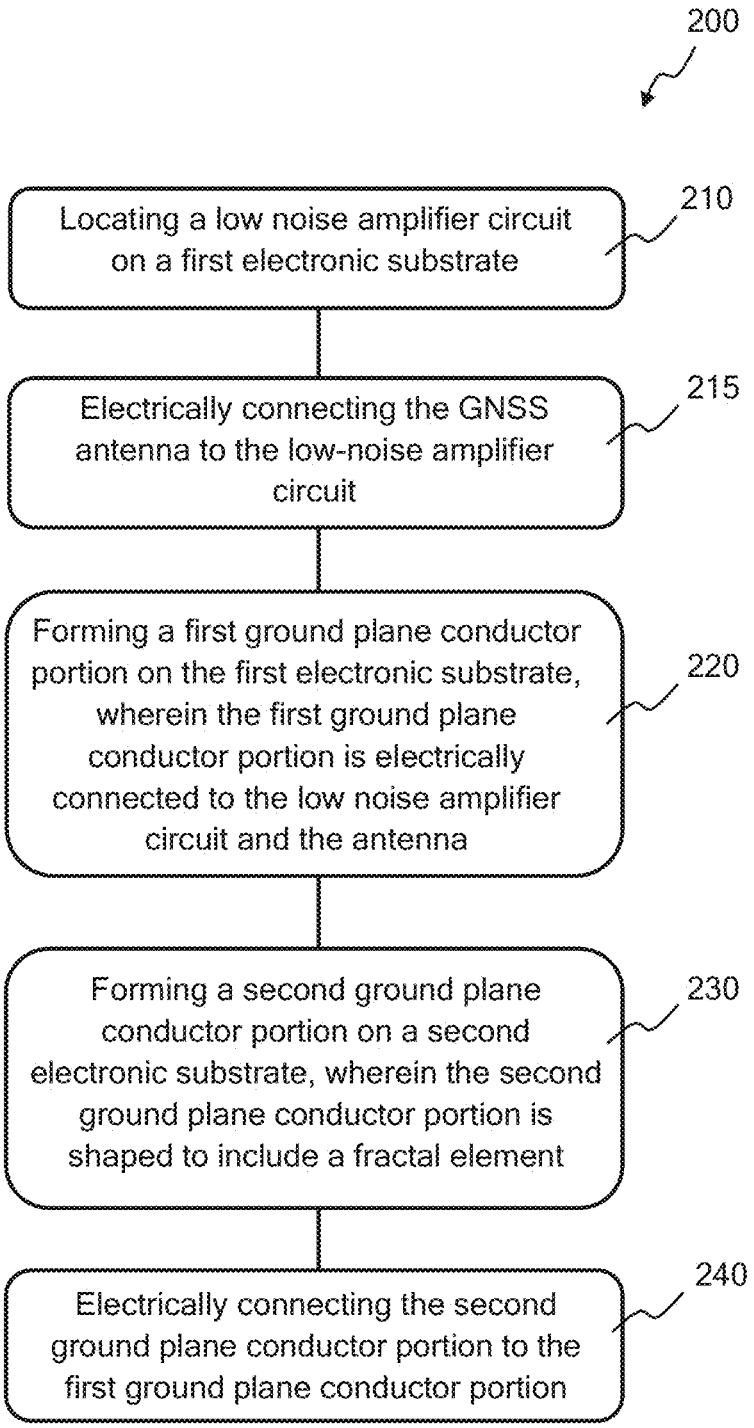
FIG. 16 illustrates method 200 of improving a gain pattern of a GNSS antenna according to an embodiment of the invention.

FIG. 16 illustrates method 200 of improving a gain pattern of a global navigation satellite system (GNSS) antenna. Method 200 includes element 210 of forming a low noise amplifier circuit on a first electronic substrate, and element 215 of electrically connecting the GNSS antenna to the low noise amplifier circuit. Method 200 also includes element 220 of forming a first ground plane conductor portion in the first electronic substrate, where the first ground plane conductor portion is electrically connected to the low noise amplifier circuit and the antenna. Method 200 also includes element 230 of forming a second ground plane conductor portion on a second electronic substrate, where the second ground plane conductor portion is shaped to include a fractal pattern. Method 200 also includes element 240 of electrically connecting the second ground plane conductor portion to the first ground plane conductor portion.

Method 200 can include many other elements. In some embodiments method 200 includes encircling the low noise amplifier circuit and the GNSS antenna with the second electronic substrate. In some embodiments method 200 includes forming a third ground plane conductor portion on a third electronic substrate, where the third ground plane conductor portion is shaped to include a fractal pattern. In some embodiments method 200 includes electrically connecting the third ground plane conductor portion to the first ground plane conductor portion. In some embodiments method 200 includes encircling the second electronic substrate with the third electronic substrate. In some embodiments the second electronic substrate is coupled to the first electronic substrate such that the angle between the first electronic substrate and the second electronic substrate is between 25 degrees and 155 degrees. In some embodiments the second electronic substrate is coupled to the first electronic substrate such that the angle between the first electronic substrate and the second electronic substrate is between 70 and 110 degrees. In some embodiments the second electronic substrate is coupled to the first electronic substrate such that the angle between the first electronic substrate and the second electronic substrate is between 80 and 100 degrees. In some embodiments the second electronic substrate is coupled to the first electronic substrate such that the angle between the first electronic substrate and the second electronic substrate is about 90 degrees.

In some embodiments electrically connecting the second ground plane conductor portion to the first ground plane conductor portion comprises electrically connecting the second ground plane conductor portion to the first ground plane conductor portion at a plurality of ground connection points, where the ground connection points are at the periphery of the first electronic substrate.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. An electronic circuit comprising:

an antenna, wherein the antenna is configured to receive GNSS satellite signals;

a low noise amplifier circuit electrically connected to the antenna; wherein the low noise amplifier circuit resides on a first electronic substrate;

and a ground plane electrically connected to the low noise amplifier circuit, wherein the ground plane comprises:

a first ground plane conductor portion, wherein the first ground plane conductor portion resides on the first electronic substrate; and a second ground plane conductor portion, wherein the second ground plane conductor portion is shaped to comprise at least one fractal pattern, and wherein the second ground plane conductor portion electrically connects to the first ground plane conductor portion.

2. The electronic circuit of claim 1, wherein the second ground plane conductor portion resides on a second electronic substrate.

3. The electronic circuit of claim 1, wherein the second ground plane conductor portion forms an annular ring around the antenna.

4. The electronic circuit of claim 1, wherein the second ground plane conductor portion forms a segment of an annular ring.

5. The electronic circuit of claim 1, wherein the second ground plane conductor portion forms a rectilinear shape surrounding the antenna.

6. The electronic circuit of claim 1, wherein the second ground plane conductor portion comprises a plurality of secondary ground plane conductor portions, wherein each of the plurality of secondary ground plane conductor portions is shaped to include at least one fractal pattern, and wherein each of the plurality of secondary ground plane conductor portions is electrically connected to the first ground plane conductor portion at one of a plurality of ground connection points, wherein each of the plurality of ground connection points is positioned on a periphery of the first electronic substrate.

7. A global navigation satellite system (GNSS) navigation device comprising:

an electronic circuit formed on a first electronic substrate, wherein the electronic circuit comprises a first ground plane conductor portion;

an antenna electrically coupled to the electronic circuit, wherein the antenna is configured to receive GNSS satellite signals;

a second ground plane conductor portion formed on a second electronic substrate, wherein the second ground plane conductor portion is shaped to include a fractal pattern, and wherein the second ground plane conductor portion is electrically connected to the first ground plane conductor portion;

a third ground plane conductor portion formed on a third electronic substrate, wherein the third ground plane conductor portion is shaped to include a fractal pattern, and wherein the third ground plane conductor portion is electrically connected to the first ground plane conductor portion;

and a fourth ground plane conductor portion formed on a fourth electronic substrate, wherein the fourth ground plane conductor portion is shaped to include a fractal pattern, and wherein the fourth ground plane conductor portion is electrically connected to the first ground plane conductor portion.

8. The GNSS navigation device of claim 7, wherein the electronic circuit comprises a low noise amplifier circuit.

9. The GNSS navigation device of claim 7, wherein each of the second electronic substrate, the third electronic substrate and the fourth electronic substrate are mechanically coupled to a periphery of the first electronic substrate.

10. The GNSS navigation device of claim 7, wherein the first electronic substrate comprises:

a first step, wherein the second electronic substrate is coupled to the first step;

a second step, wherein the third electronic substrate is coupled to the second step;

and a third step, wherein the fourth electronic substrate is coupled to the third step.

11. The GNSS navigation device of claim 7, wherein each of the second electronic substrate, the third electronic substrate and the fourth electronic substrate are formed of a flexible printed circuit board.

12. The GNSS navigation device of claim 11, wherein the second electronic substrate, the third electronic substrate and the fourth electronic substrate form concentric annular rings around the antenna.

13. The GNSS navigation device of claim 12, wherein an angle between the first electronic substrate and the second electronic substrate is between 70 degrees and 110 degrees.

14. The GNSS navigation device of claim 12, wherein:

the second ground plane conductor portion extends a first height above the first electronic substrate;

the third ground plane conductor portion extends a second height above the first electronic substrate, wherein the second height is greater than the first height;

and the fourth ground plane conductor portion extends a third height above the first electronic substrate, wherein the third height is greater than the second height.

15. A method of improving a gain pattern of a global navigation satellite system (GNSS) antenna, the method comprising:

locating a low noise amplifier circuit on a first electronic substrate;

electrically connecting the GNSS antenna to the low noise amplifier circuit;

forming a first ground plane conductor portion on the first electronic substrate, wherein the first ground plane conductor portion is electrically connected to the low noise amplifier circuit and the antenna;

forming a second ground plane conductor portion on a second electronic substrate, wherein the second ground plane conductor portion is shaped to include a fractal pattern;

and electrically connecting the second ground plane conductor portion to the first ground plane conductor portion.

16. The method of claim 15, further including encircling the GNSS antenna with the second electronic substrate.

17. The method of claim 16, further comprising:

forming a third ground plane conductor portion on a third electronic substrate, wherein the third ground plane conductor portion is shaped to include a fractal pattern;

and electrically connecting the third ground plane conductor portion to the first ground plane conductor portion.

18. The method of claim 17, further comprising encircling the second electronic substrate with the third electronic substrate.

19. The method of claim 15, wherein forming a second ground plane conductor portion on a second electronic substrate comprises forming the second ground plane conductor portion with a shape that includes a fractal base generator pattern replicated in at least two sizes and at least two orientations.

20. The method of claim 15, wherein electrically connecting the second ground plane conductor portion to the first ground plane conductor portion comprises electrically connecting the second ground plane conductor portion to the first ground plane conductor portion at a plurality of ground connection points, wherein the ground connection points are at the periphery of the first electronic substrate.

* * * * *